US009526283B1

(12) United States Patent
Jorgenson

(10) Patent No.: US 9,526,283 B1
(45) Date of Patent: Dec. 27, 2016

(54) METHOD OF SECURING A NECKTIE USING A TIE LINK

(71) Applicant: Steven Jorgenson, Ettrick, WI (US)

(72) Inventor: Steven Jorgenson, Ettrick, WI (US)

( * ) Notice: Subject to any disclaimer, the term of this patent is extended or adjusted under 35 U.S.C. 154(b) by 447 days.

(21) Appl. No.: 14/171,329

(22) Filed: Feb. 3, 2014

Related U.S. Application Data

(60) Provisional application No. 61/760,478, filed on Feb. 4, 2013.

(51) Int. Cl.
*A41D 25/00* (2006.01)
*A44B 6/00* (2006.01)

(52) U.S. Cl.
CPC ..... *A41D 25/003* (2013.01); *A44B 6/00* (2013.01); *Y10T 24/19* (2015.01); *Y10T 24/1976* (2015.01); *Y10T 24/312* (2015.01)

(58) Field of Classification Search
CPC ..... Y10T 24/1962; Y10T 24/1976; Y10T 24/1917; Y10T 24/312; Y10T 24/1924; Y10T 24/19; A44B 9/08; A44B 6/00; A41D 25/003
USPC ..... 24/713.1, 715.4, 715.7; 2/145
See application file for complete search history.

(56) References Cited

U.S. PATENT DOCUMENTS 877,478 A * 1/1908 Barnard ..... B42F 13/02 24/127
2,084,503 A * 6/1937 Rogers ..... A44B 6/00 24/299
2,274,269 A * 2/1942 Jellinek ..... A44C 15/001 24/299
2,743,452 A * 5/1956 Waterbury ..... A41D 25/003 2/145
2,813,273 A * 11/1957 Schreter ..... A41D 25/003 2/145
3,523,339 A * 8/1970 Laviano ..... A44B 9/10 24/49.1
4,554,710 A * 11/1985 Grant ..... A44B 6/00 24/304
4,827,576 A * 5/1989 Prince, Jr. ..... A44B 6/00 2/145
5,046,221 A * 9/1991 Walker ..... A41D 25/003 24/66.2
5,095,546 A * 3/1992 Jones ..... A41D 25/003 2/144
5,216,785 A * 6/1993 Graef ..... A41D 25/003 24/66.2
5,235,730 A * 8/1993 Townsend ..... A44B 6/00 24/3.13
5,245,708 A 9/1993 Campelia
5,337,457 A 8/1994 Chennault
5,353,438 A 10/1994 Voiles
5,375,301 A 12/1994 Schindler
5,669,242 A * 9/1997 Cayton ..... A44C 11/002 24/299

(Continued)

*Primary Examiner* — Robert J Sandy
(74) *Attorney, Agent, or Firm* — Boardman & Clark LLP

(57) ABSTRACT

A tie link for securing a necktie is disclosed. The tie link includes a flexible link insertable through a strap on a necktie and extending a length which spans from a first shirt button hole to a second shirt button hole on a shirt. The tie link has a plurality of retention devices coupled to the flexible link. The retention devices extend perpendicular to the flexible link and are insertable into a respective plurality of button hole slots on the shirt. A method of securing a necktie is also disclosed.

6 Claims, 3 Drawing Sheets

(56) References Cited

U.S. PATENT DOCUMENTS

| | | | | |
|---|---|---|---|---|
| D420,778 | S | 2/2000 | Roberts | |
| 6,182,292 | B1 | 2/2001 | Knoll | |
| D453,911 | S | 2/2002 | Yancy | |
| 6,857,167 | B2 | 2/2005 | Bishop | |
| 6,954,943 | B1 | 10/2005 | Boyko | |
| 7,065,794 | B2 | 6/2006 | Anderson | |
| 7,346,934 | B1 | 3/2008 | Scott | |
| 7,370,371 | B2 | 5/2008 | Butterfas | |
| 7,698,749 | B2 | 4/2010 | Littlejohn | |
| 7,930,806 | B2 | 4/2011 | Funk | |
| 8,966,716 | B1 * | 3/2015 | Mortimer | A44B 6/00 24/56 |
| 2004/0006849 | A1 * | 1/2004 | Bishop | A41D 25/003 24/3.4 |

* cited by examiner

METHOD OF SECURING A NECKTIE USING A TIE LINK

CROSS-REFERENCE TO RELATED APPLICATIONS

This application claims the benefit of and priority to U.S. Provisional Patent Application Ser. No. 61/760,478 entitled "A Device to Limit Necktie Movement Using Shirt Button Holes and the Necktie Back Strap" filed Feb. 4, 2013, the entire contents of which is hereby incorporated by reference herein in its entirety.

FIELD

The invention(s) herein relate to devices for neckties. More specifically, the inventions herein relate to a device to limit necktie movement using, for example, shirt button holes and the necktie back strap.

BACKGROUND

A common problem experienced by users or wearers of neckties is the tie does not remain in place. It is common for the tie to move as a result of the motion of the user (e.g., side-to-side, forward, etc.). As a result, the necktie can often get in the way of the wearer and damaged by coming into contact with food, machines, and other items. Therefore many users desire to use a device to keep the necktie in place and close to the shirt.

Various attempts have been made to solve this problem. The most common devices to limit necktie movement are tie tacks, tie clips, and tie chains. Tie tacks often create a bulge in the necktie and damage the necktie, as it is necessary to pierce a hole through the necktie to secure the tack. Devices which attach to the buttons of the shirt cause too much stress on the buttons and ultimately result in separating the buttons from the shirt over time. Tie clips and tie chains do not damage the tie, but are loosely held on the clothing, and as a result often fall off or do not remain in position. Tie clips and tie chains are also visible, as they are worn so as to cross the front of the necktie. Accordingly, none of these solutions is sufficient if the wearer does not want the device to be visible.

Devices also exist which are worn entirely under the necktie, such as a strap or a pin. Unfortunately, these devices lack aesthetic and design qualities, are rigid and uncomfortable, and put additional stress on the shirt's buttons.

Once the wearer fastens the necktie, there is no really good solution to keep it in place over the buttons of a shirt. Accordingly, what is needed is a device which keeps a necktie in place over a dress shirt without damage to the necktie or a sacrifice in comfort or style.

SUMMARY

Accordingly, a device for necktie control, namely a device to limit necktie movement using shirt button holes and the necktie back strap is disclosed. In particular, a device for necktie control is disclosed. The device includes a flexible link coupled to a first retention device on a first end of the flexible link and a second retention device on the second end of the flexible link.

A tie link for securing a necktie is also disclosed. The tie link includes a flexible link insertable through a strap on a necktie and extending a length which spans from a first shirt button hole to a second shirt button hole on a shirt. The tie link has a plurality of retention devices coupled to the flexible link. The retention devices extend perpendicular to the flexible link and are insertable into a respective plurality of button hole slots on the shirt.

A method of securing a necktie is also disclosed. The method includes the steps of inserting a first end of a tie link through a strap on the back of a necktie a distance sufficient such that a first end and a second end of the tie link are on opposing sides of the strap and both ends of the tie link are accessible. A first retention device coupled to the tie link is inserted through a first button hole of a shirt. A second retention device coupled to the tie link is inserted through a second button hole of the shirt. The button holes are most closely above and below the position of the strap, wherein once installed the retention devices provide a secure anchoring for each end of the flexible link which holds the necktie close to the wearer's shirt while allowing some movement in the necktie for user comfort.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

A device for necktie control, or to limit necktie movement, using shirt button holes and the necktie back strap is disclosed and illustrated herein in reference to the Figures. The device or tie link as referred to herein has a plurality of fabric engaging retention devices or end bars coupled together by a flexible link. In one or more examples of embodiments, the end bars are joined to the flexible link by a connecting link 118 or other fastening device. Accordingly, a device for necktie control is provided comprising a flexible link coupled to a first retention device on a first end of the flexible link and a second retention device on the second end of the flexible link.

Figure 1:
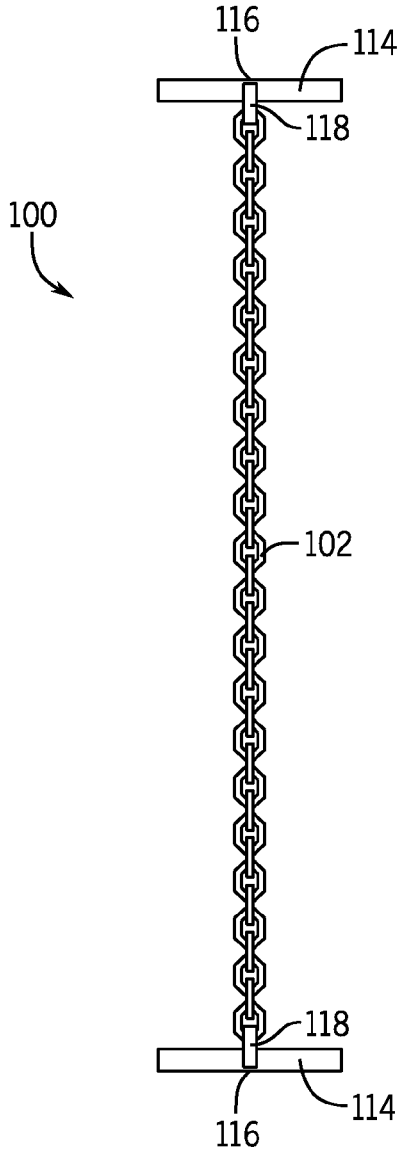
FIG. 1 is an elevation view of a tie link according to one or more examples of embodiments.

Referring to the Figures, in one or more examples of embodiments, the tie link 100 or device for necktie control has a flexible link 102. The flexible link 102 is flexible in that it provides a limited degree of movement of a connected necktie as further described herein. In one example, as shown in FIG. 1, the flexible link 102 is a chain. In an alternative example, the flexible link 102 is a strap or ribbon. The flexible link 102 has a length sufficient to extend between at least two button holes 104 on a shirt 106 (see FIG. 2), and in one or more examples of embodiments may have a length which extends between at least three button holes. Preferably, the length of the flexible link 102 is sufficient such that the tie link extends to, or between, a dress shirt's button holes 104 directly above and below the necktie label strap or back strap 108 (see FIG. 3). In addition, the flexible link 102 may have a length which extends slightly beyond the button holes 104 such that there is an amount of play available for limited movement and/or attachment. It is understood that while specific examples are described herein, the length may be any length suitable for the intended purposes. Additional flexible links, such as chains or other materials, may be added in series or in parallel. Variations in the design or materials used for the chain (as well as the end bars described in further detail herein below) can also be added for style, complexity, and personalization. Variations in width of the flexible link element may also be implemented (e.g., increased or decreased width or combinations thereof) to, for example, limit necktie movement.

Figure 4:
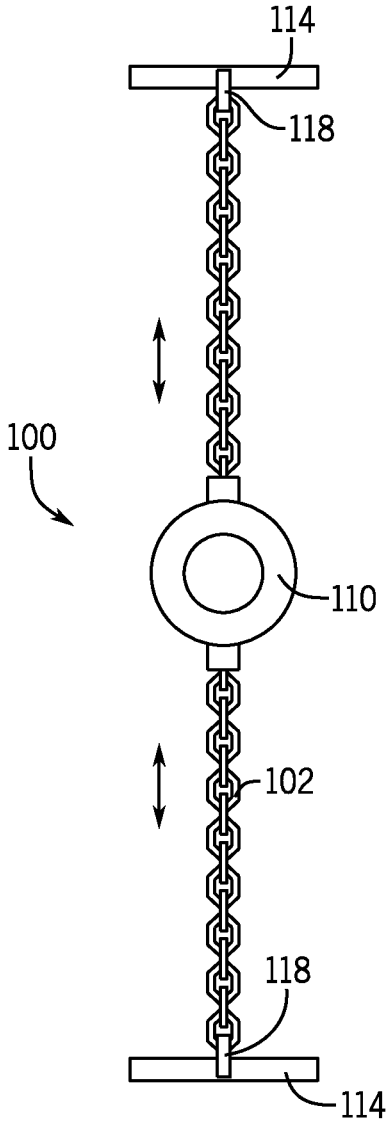
FIG. 4 is an elevation view of an extension device for use with the tie link according to one or more examples of embodiments.

In addition to the foregoing, the tie link 100 may have an extension device 110 or variable length mechanism which provides a degree of adjustment to accommodate variations in distance between buttons 112 and/or to provide a degree of play as described above. As shown in FIG. 4, the extension device 110 or variable length mechanism may be an extendable/retractable device and in one or more examples of embodiments may include a locking device such that the length can be adjusted and secured. In one or more alternative examples, the extension device 110 may have a degree of elasticity or include an elastic material such that the distance can be increased and decreased. An example of a suitable extension device 110 includes, but is not limited to, a gear-type dial or push button providing releasable tension to an attached flexible link 102. One example, showing a push button mechanism for releasable extension and tension is illustrated in FIG. 4. It is understood that the examples provided herein are for purposes of example only, and other now known or future developed devices may be substituted in place of the extension device 110 described herein which device accomplishes the same purpose.

The tie link 100 includes a plurality of end bars 114 or fabric engaging retention devices. The end bars 114 shown in FIGS. 1-5 are rods which extend perpendicular to the flexible link 102 in the flexible link's fully extended form shown in the Figures. The end bar(s) 114 have a length which is sufficient to resist pulling out from its engaged position in a button hole 104 in a shirt 106. The end bars 114 are engageable with the button hole(s) 104 in a shirt 106, and preferably do not attach to the buttons 112. The end bar(s) 114 has a length which is less than the length of the flexible link 102. The width of the end bar(s) 114 may vary within a range suitable for engaging with the button hole 104 in a shirt 106. The end bars 114 may also have or be comprised of a decorative feature or design.

The flexible link 102 couples to a central portion 116 of each end bar 114. The end bars 114 may be directly connected to the flexible link 102. In one or more alternative examples of embodiments, the end bars 114 are optionally coupled to the flexible link 102 by a connecting link 118 or other fastening device, such as is shown in FIG. 1. The coupling of the end bar 114 and flexible link 102, and/or the connecting link 118, permits movement of the end bar 114 relative to the flexible link 102 or a portion thereof. In one or more alternative embodiments, the coupling of the end bar 114 and flexible link 102, and/or the connecting link 118, rigidly couples the end bar 114 to the flexible link 102 or a portion thereof.

The tie link 100 and its various components may be made of any material suitable for the intended purposes. Preferably, the tie link 100 is composed at least in part of a material which is flexible, yet durable. The tie link 100 may be further formed of a material which has a sufficient strength so that it will not break, but will not damage the fabric of a tie or shirt or other material to which it is attached, examples of which include but are not limited to metals and plastics which are substantially without rough edges and burrs. For instance, the tie link 100 may be formed of a polished metal or precious metal. The fabric engaging retention devices or end bars 114 may be formed of a material having sufficient rigidity to retain the tie link 100 in place on the fabric. Examples include, but are not limited to, various metals and/or plastics and combinations thereof. The flexible link 102 may be formed of a material having sufficient flexibility to permit some movement of the tie relative to the shirt 106 when engaged, and comprises a strength sufficient to resist breakage upon application of pulling forces. The flexible link 102 may be formed of a metal, a plastic, a fabric, an elastic, and the like, and combinations thereof. In one or more illustrated examples of embodiments, the flexible link is a chain such as shown in the Figures. The connecting links 118 and extension device 110 may be similarly formed of metal, plastic, and other suitable materials, and combinations thereof. While specific examples are given, variations thereon may be used which are acceptable for the purposes provided.

An example of a method of making one or more examples of the tie link 100 will now be described. For instance, a length of chain or other similarly flexible material for the flexible link 102 is procured and cut to an appropriate length. The flexible link 102 may be cut to a length suitable to span between at least two or at least three button holes 104 and allow a small amount of play. An end bar 114 is then attached to each end of the chain directly or through the use of a connecting link 118 depending on the specific type of end bar and type of flexible link material that is used.

Figure 2:
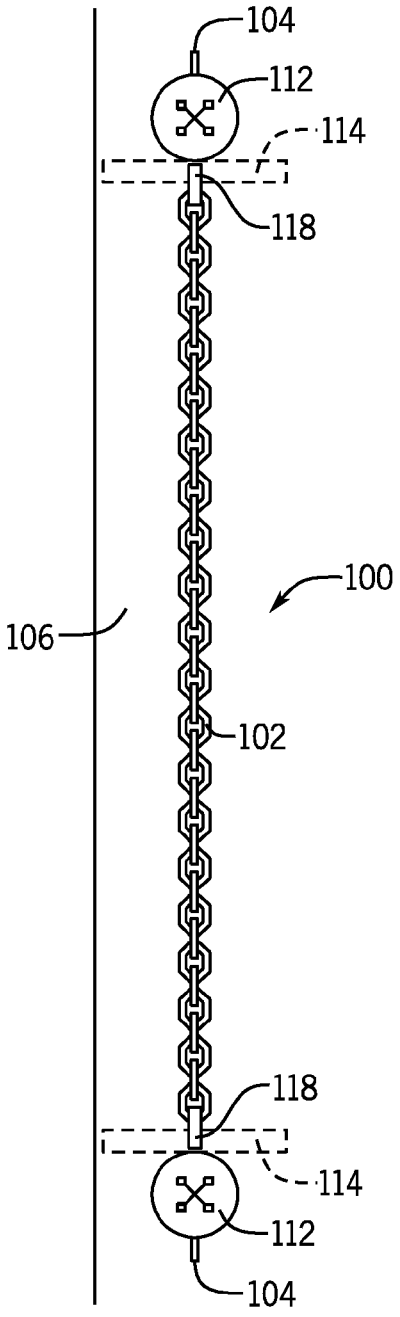
FIG. 2 is an elevation view of the tie link of FIG. 1, showing a portion of the tie link inserted through button holes in a shirt.
Figure 3:
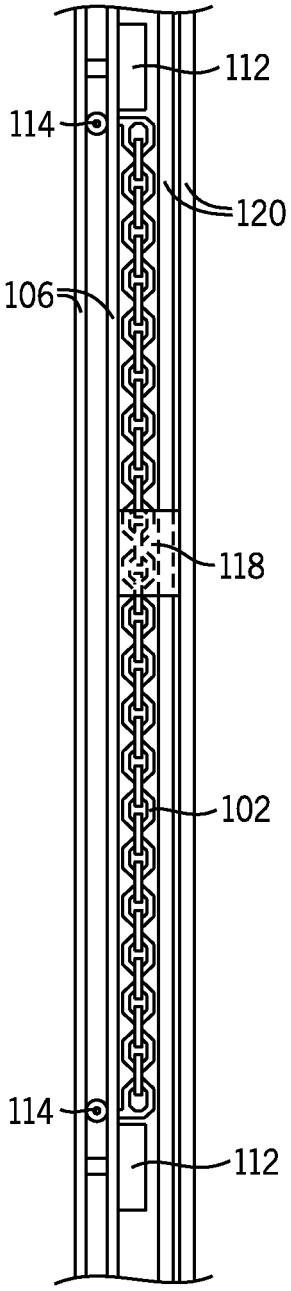
FIG. 3 is a side elevation view of the tie link of FIG. 1, showing the combined placement of the tie link through the button holes in a shirt and placement on the back of a necktie.
Figure 5:
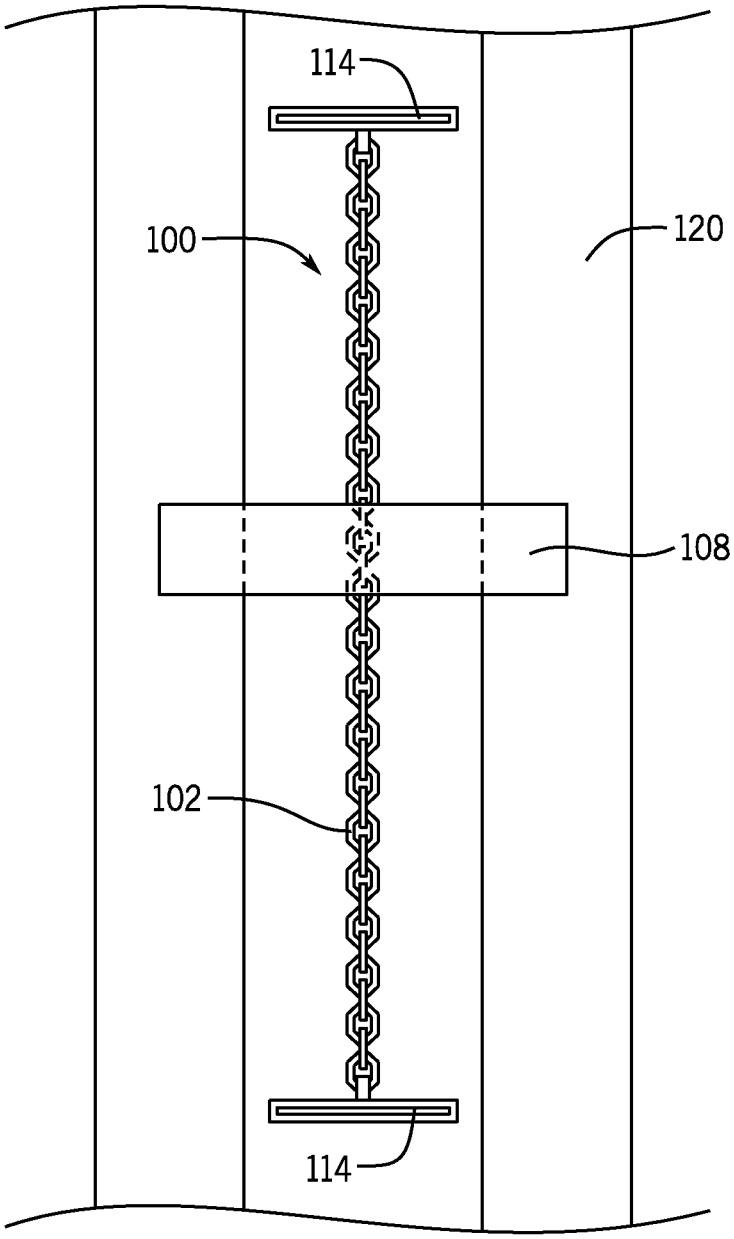
FIG. 5 is an elevation view of the tie link of FIG. 1, showing the placement of the tie link on the back of a necktie.

One or more examples of a method of use of the tie link 100 are now described in reference to the Figures. In reference to FIGS. 2-3 and 5, preferably, the tie link 100 device is worn between the necktie 120 and the dress shirt 106 (FIG. 3) and limits necktie 120 movement through use of the necktie's own label strap or back strap 108. Each end of the device is securely anchored in a dress shirt's button holes 104 directly above and below the necktie's label strap or back strap 108 (FIG. 2). The tie link 100 is also secured to the necktie 120 by insertion through the strap 108 on the back of the necktie (FIG. 5). As a result, a low-profile, attractive, and comfortable way of keeping the necktie 120 in its proper position is provided.

In order to accomplish the foregoing, the flexible link 102 or chain is inserted between the necktie's strap 108 or label strap and the back of the necktie 120 such as shown in FIG. 5. This may be accomplished by inserting a first end of the tie link 100 through the strap 108 a distance sufficient such that the first end and second end are on opposing sides of the strap 108 and both ends of the tie link 100 are accessible. The end bars 114 are attached by insertion through the button holes 104 of a dress shirt 106 that are most closely above and below the position of the strap 108 on the back of a properly positioned necktie 120. At least one end bar 114 may be inserted into the button hole 104 prior to insertion of the tie link 100 through the strap 108 or after the tie link is inserted into the strap. In this situation, the second end bar 114 is then inserted into the corresponding button hole 104 on the shirt 106. Once installed, the end bars 114 provide a secure anchoring for each end of the flexible link 102. In this position, the flexible link 102 holds the necktie 120 close to the wearer's shirt 106 (see FIG. 3) while still allowing some movement in the necktie for user comfort.

More specifically, while in an upright position and wearing a dress shirt 106 and a properly positioned necktie, the user or wearer would first insert one of the end bars 114 from the front of the dress shirt 106 through the button hole 104 directly above the necktie's label/back strap 108. The end bar 114 of the tie link 100 may be inserted through the portion of the button hole 104 between the button 112 and the lower edge of the button hole 104. The length of the end bar 114 is now on the backside of the button hole 104, and the user turns the end bar 114 perpendicular to the slit of the first button hole 104, then pulls the flexible link 102 or chain taut (e.g., downward) for positioning. The unsecured end bar 114 and flexible link 102 or chain are then inserted through the necktie's strap 108 or label strap or other similar strap on the back of the necktie 120. The unsecured end bar 114 is then inserted from the front of the dress shirt 106 through the second button hole 104, which is directly below the necktie's label/back strap 108. This second end bar 114 is inserted through the portion of the button hole 104 between the button 112 and the upper edge of the button hole. The user then turns the end bar 114 perpendicular to the slit of the second button hole 104, and the flexible link 102 or chain is pulled taut (e.g., upward) to complete the process. The necktie's movement is now limited in a discrete, stylish, and comfortable manner.

The tie link described herein overcomes problems of keeping a necktie in place over a dress shirt without damage to the necktie and/or a sacrifice in comfort or style. The tie link does not require poking or damaging the tie to attach the device. Further the tie link remains secured to the shirt and in place. Thus, the link does not fall off and does not need constant readjustment. Moreover, the flexibility provided by the flexible link does not inhibit wearer movement.

The invention described herein improves the ability of the user to keep the necktie in place and close to the shirt by limiting side-to-side and forward movement better than most existing solutions, and yet still allows enough vertical movement to be comfortable. Moreover, the tie link is more secure than most other solutions. The tie link is also discrete and does not intrude on the look of the necktie. The end bars and flexible link may be provided in a variety of designs to satisfy different personalities, allowing the user to accommodate personal style and taste. As a result, the tie link may be provided with an elegant and stylish appearance if noticed, unlike other devices worn entirely behind the necktie.

The tie link differs from devices that currently exist in that it eliminates damage to the necktie, stays in place, and is not easily lost. The tie link keeps the necktie closer to the body, and is more comfortable than other existing devices with similar purpose. None of the prior devices for limiting necktie movement provide the ideal combination of function, style and comfort for the wearer.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. A method of securing a necktie comprising:

inserting a first end of a tie link through a strap positioned on a back of a necktie a distance sufficient such that the first end and a second end of the tie link are on opposing sides of the strap and both ends of the tie link are accessible;

inserting a first retention device coupled to the tie link through a first button hole of a shirt and inserting a second retention device coupled to the tie link through a second button hole of the shirt, which said button holes are most closely above and below the position of the strap, wherein once installed the retention devices provide a secure anchoring for each end of the flexible link which holds the necktie close to the wearer's shirt while allowing some movement in the necktie for user comfort.

2. The method of claim 1, wherein the retention devices are end bars.

3. The method of claim 1, wherein the retention devices have a decorative feature.

4. The method of claim 1, wherein the first retention device is inserted into the first button hole in the shirt prior to inserting the first end of the tie link through the strap positioned on the back of the necktie.

5. The method of claim 1, wherein the button holes most closely above and below the position of the strap are spaced apart by an additional button hole.

6. The method of claim 1, wherein the button holes most closely above and below the position of the strap are adjacent to one another.

* * * * *